United States Patent [19]

Bergeron et al.

[11] Patent Number: 5,074,088

[45] Date of Patent: Dec. 24, 1991

[54] BUILDING BLOCK

[75] Inventors: Denis Bergeron, Lac-à-la-Tortue; Conrad Trudel; Pierre St Ours, both of St-Georges-de-Champlain, all of Canada

[73] Assignee: Ultra Gestion, Inc., Quebec, Canada

[21] Appl. No.: 622,793

[22] Filed: Dec. 5, 1990

[30] Foreign Application Priority Data

Aug. 22, 1990 [CA] Canada ..... 2023754

[51] Int. Cl.[5] ..... E04B 2/28

[52] U.S. Cl. ..... 52/309.12; 52/565

[58] Field of Search ..... 52/309.12, 562, 565, 52/591

[56] References Cited

U.S. PATENT DOCUMENTS

| | | | |
|---|---|---|---|
| 783,452 | 2/1905 | Morenus | 52/565 |
| 4,177,617 | 12/1979 | DeLuca et al. | 52/562 |
| 4,967,528 | 11/1990 | Doran | 52/562 |

*Primary Examiner*—David A. Scherbel
*Assistant Examiner*—Wynn E. Wood
*Attorney, Agent, or Firm*—Longacre & White

[57] ABSTRACT

The building block comprises spaced apart outer and inner concrete walls and a pair of tie members for interconnecting these two walls. Each tie member has a first T-shaped end embedded into the concrete of the outer wall. A solid and cubic body is made of wood and is fastened to a second end of each tie member. For that purpose, each body has a hole therein, and the second end of each tie member is forked to define first and second branches embracing a portion of the body and having respective free ends bent to penetrate the hole through its two ends, respectively. The cubic body defines edges having a length equal to the thickness of the inner wall, and it is embedded in the concrete of this inner wall with a surface thereof exposed on the two sides of the latter wall. Nailing and/or screwing through the cubic body is therefore enabled from the outer side of the inner wall with the nails and/or screws extending in the space between the outer and inner walls. Also, a wall constructed with building blocks in accordance with the invention comprises an inner, empty space that can be easily filled with loose fill insulation.

7 Claims, 3 Drawing Sheets

BUILDING BLOCK

BACKGROUND O THE INVENTION

1. Field of the invention

The present invention relates to a building block comprising spaced apart outer and inner walls made of hard moldable material such as concrete and interconnected through tie members.

2. Brief description of the prior art

Many building blocks of the above type have been proposed in the prior art. Such building blocks usually comprise outer and inner concrete walls which are spaced apart from each other but interconnected through at least two tie members. Examples are illustrated and described in U.S. Pat. No. 783,452 (Morenus) issued on Feb. 28, 1905, in U.S. Pat. No. 1,448,648 granted to H. Wilkins on Mar. 13, 1923, in U.S. Pat. No. 1,778,881 (Alford) granted on Oct. 21, 1930, and in in the name of DeLuca et al.

All these prior art building blocks present a common major drawback. After a wall has been erected with these blocks, they do not enable easy nailing and/or screwing upon finishing of the inside of the so erected wall.

OBJECT OF THE INVENTION

The main object of the present invention is therefore to eliminate the above discussed drawback of the prior art by embedding in the concrete of the inner wall of each block a body made of material through which nails and/or screws can be easily driven.

SUMMARY OF THE INVENTION

More specifically, in accordance with the present invention, there is provided a building block comprising outer and inner walls, at least one elongated tie member, and a body made of material through which nails and/or screws can be driven. At least the inner wall is made of hard moldable material such as concrete. The tie member interconnects the two walls with a space separating the outer wall from the inner one, and it comprises a first end fixedly secured to the outer wall and a second end fixedly secured to the inner wall. The body is fastened to the second end of the tie member and embedded in the material of the inner wall with a surface thereof exposed on the outer side of the inner wall to enable nailing and/or screwing through that body.

After a wall has been erected using building blocks in accordance with the invention, one can easily nail and/or screw into the different bodies when finishing the inside of the so erected wall.

According to a preferred embodiment of the subject invention, the body is a solid and cubic body made for example of wood. This cubic body defines edges each having a length equal to the thickness of the inner wall of the block. Accordingly, the cubic body also has a surface exposed in the space separating the outer wall from the inner wall whereby nails and/or screws can be driven from the outer side of the inner wall with these nails and/or screws extending in the latter space.

In accordance with another preferred embodiment of the present invention, the body has a hole therein, and the second end of the elongated tie member is forked to define first and second branches embracing a portion of the cubic body and having respective free ends bent to penetrate the hole through its two ends, respectively.

The cubic bodies are not only firmly embedded in the material of the inner walls of the blocks but they are also retained by the tie members to which they are attached. Accordingly these bodies cannot be displaced upon nailing or screwing therein.

The objects, advantages and other features of the present invention will become more apparent upon reading of the following non restrictive description of a preferred embodiment of the building block, given by way of example only with reference to the accompanying drawings.

BRIEF DESCRIPTION OF THE DRAWINGS

In the appended drawings

DETAILED DESCRIPTION OF THE PREFERRED EMBODIMENT

Figure 1:
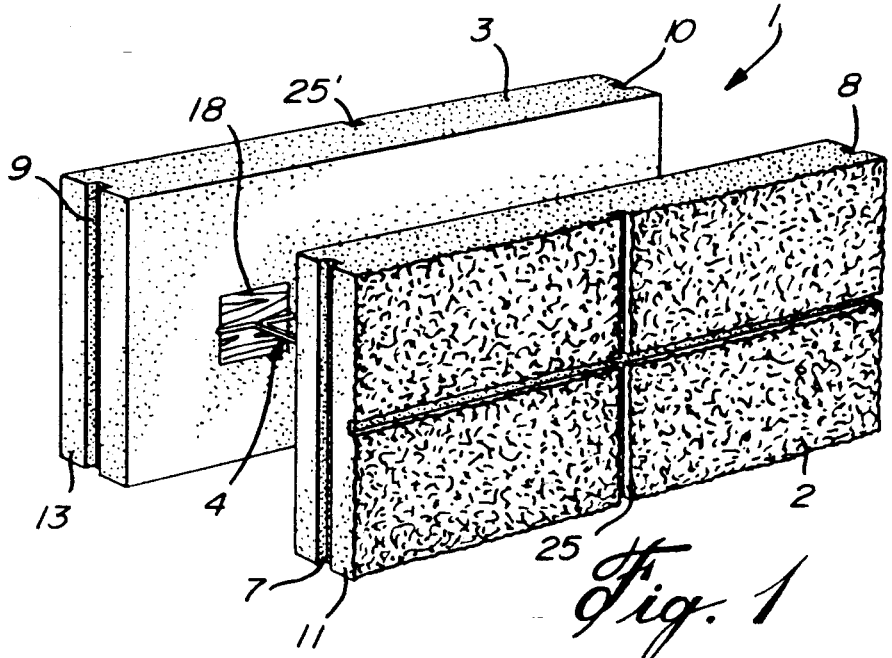
FIG. 1 is a perspective view of a building block in accordance with the present invention, comprising interconnected outer and inner

Referring now to FIGS. 1 to 4 of the appended drawings, the building block in accordance with the subject invention is generally identified by the reference numeral 1. It comprises an outer wall 2 and an inner wall 3 interconnected through a pair of steel tie members 4 and 5.

Figure 2:
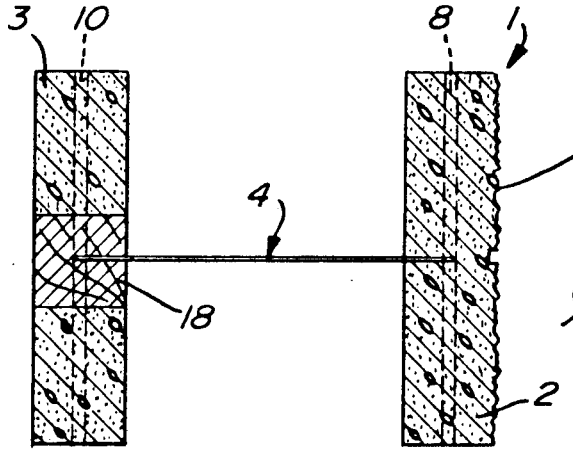
FIG. 2 is a vertical cross sectional view of the block of FIG. 1.
Figure 3:
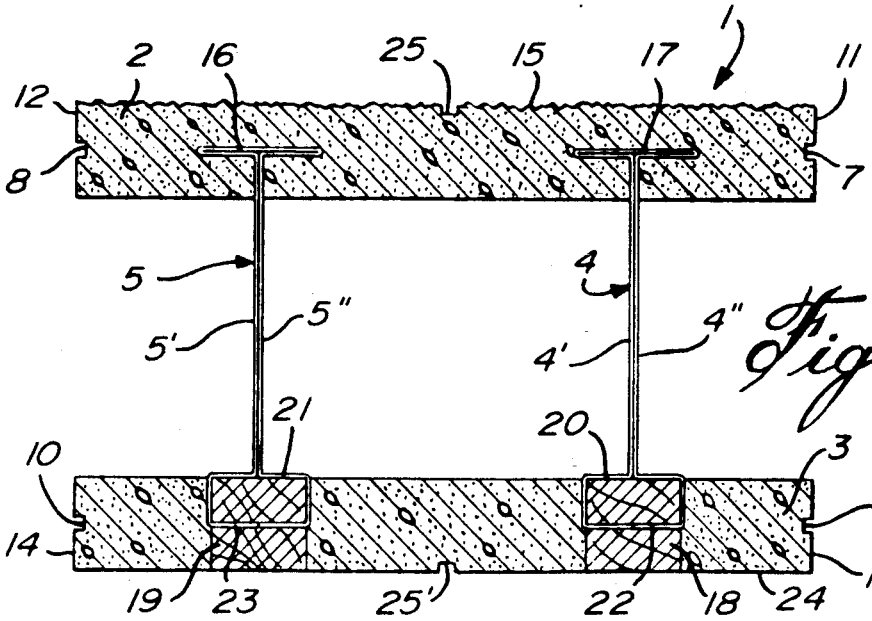
FIG. 3 is an horizontal cross sectional view of the building block of FIGS. 1 and 2.

Although other materials can be envisaged, the inner wall 3 is advantageously made of molded concrete. Regarding the outer wall 2, it can be made of molded cement, concrete, brick material or other analogous composition depending on the desired outside finish. For example, the outer face 15 of the wall 2 may present as illustrated in FIGS. 1, 2 and 3 a stone finish formed in the concrete of the wall 2. Using conventional techniques, narrow bricks can also be mounted on the concrete core of the wall 2 so that its outer face 15 presents a brick finish. The outside finish of the wall 2 is therefore a matter of imagination.

Figure 7:
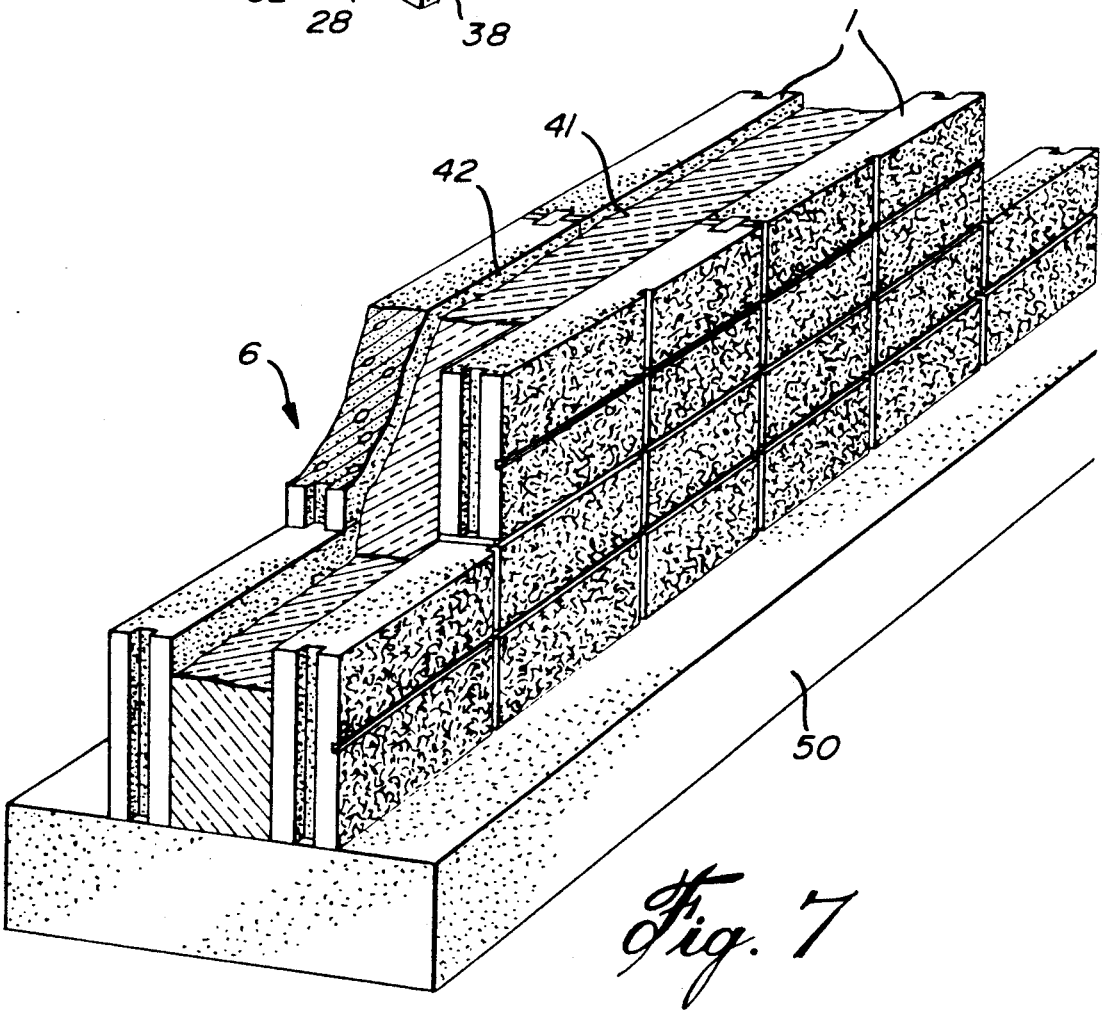
FIG. 7 illustrates a vertical wall being erected using building blocks according to the present invention.

Upon construction of a wall such as 6 on a conventional concrete footing 50 as illustrated in FIG. 7, the blocks 1 are assembled together by means of mortar or another binding composition. To improve the binding between the different blocks 1, grooves 7 and 8 are respectively formed in the end surfaces 11 and 12 of the outer wall 2, while grooves 9 and 10 are respectively molded in the end surfaces 13 and 14 of the inner block 3. Each groove 7–10 is vertical, generally rectangular in cross section, and centered on the corresponding end surface.

It will appear to those skilled in the art that, as illustrated in FIG. 1, the concrete stone-like finish of the wall 2 separates the outer face 15 into two equal parts to facilitate the molding operation.

The outer and inner walls 2 and 3 can be for example 2" thick and separated by a distance of 6 inches. The overall thickness of the building block 1 is therefore of 10 inches. The walls 2 and 3 can also be 8" high and 16" long.

The tie members 4 and 5 are formed of cylindrical steel rod having a diameter of 3/16 inch. The steel rod is bent to form each tie member 4,5 with a T-shaped end 16,17 and with a linear and elongated double section between the walls 2 and 3, which elongated section is composed of two parallel and adjacent sections 4' and 4", 5' and 5" of the cylindrical steel rod for a better rigidity of the tie members. Upon manufacture of the block the concrete or other composition of the outer wall 2 is poured on the T-shaped ends 16 and 17 to embed these ends in the wall 2 and fixedly secure the members 4 and 5 to that wall 2.

Attached to the other end 20,21 of each tie member 4,5 is a solid and cubic body 18,19 made for example of wood. To prevent problems of expansion and retention of the bodies 18 and 19 which can cause damage to the concrete of the wall 3, such wood should be hard and dry. Of course, other materials through which nails and/or screws can be driven can replace wood. In order to secure the wood bodies 18 and 19 to the ends 20 and 21 of the tie members 4 and 5, each body 18,19 comprises a central hole 22,23 therein. The end 20,21 is forked to define two branches each formed by one free end of a rod section 4',4",5',5". The branches of each forked end 20,21 embrace a portion of the body 18,19 and comprise free ends penetrating the hole 22,23 through its two ends, respectively. Such fixation of the bodies 18 and 19 prevent them from moving or turning in any direction on the tie members. Indeed, displacement of the bodies 18 and 19 during the molding operation of the inner wall 3, including pouring of the concrete, should be avoided. This allows a manufacturer to mold the block 1 in a single operation using the equipment already installed and used for molding conventional concrete blocks.

The concrete of the inner wall 3 is poured on the ends 20 and 21 of the tie members 4 and 5 as well as on the cubic bodies 18 and 19 whereby these member ends and bodies are embedded in the concrete for an adequate fixation to the inner wall 3.

As illustrated in FIG. 3, the length of an edge of each cubic body 18,19 is equal to the thickness of the inner wall 3 (2" long for an inner wall 2" thick). The bodies 18 and 19 are therefore exposed on the outer face 24 of the wall 3 to enable nailing and/or screwing through these bodies from the inside of wall 6 (FIG. 7) with the nails and/or screws extending within the space between the outer and inner walls 2 and 3.

Figure 4:
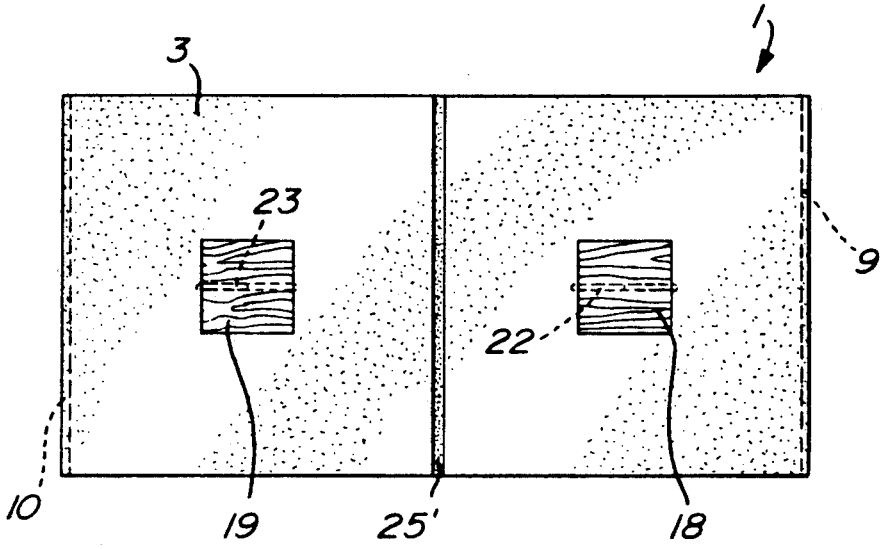
FIG. 4 illustrates the outer side of the inner wall of the block 1, 2 and 3.

Referring to FIG. 4, the position of the bodies 18 and 19 as well as the distance separating these two bodies are selected to enable finishing of the inside of the wall 6 using conventional techniques and materials.

The outer faces 15 and 24 of the outer and inner walls 2 and 3 are formed with a vertical and central groove 25 and 25' whose function is to enable cutting of the block 1 in two equal sections.

Figure 5:
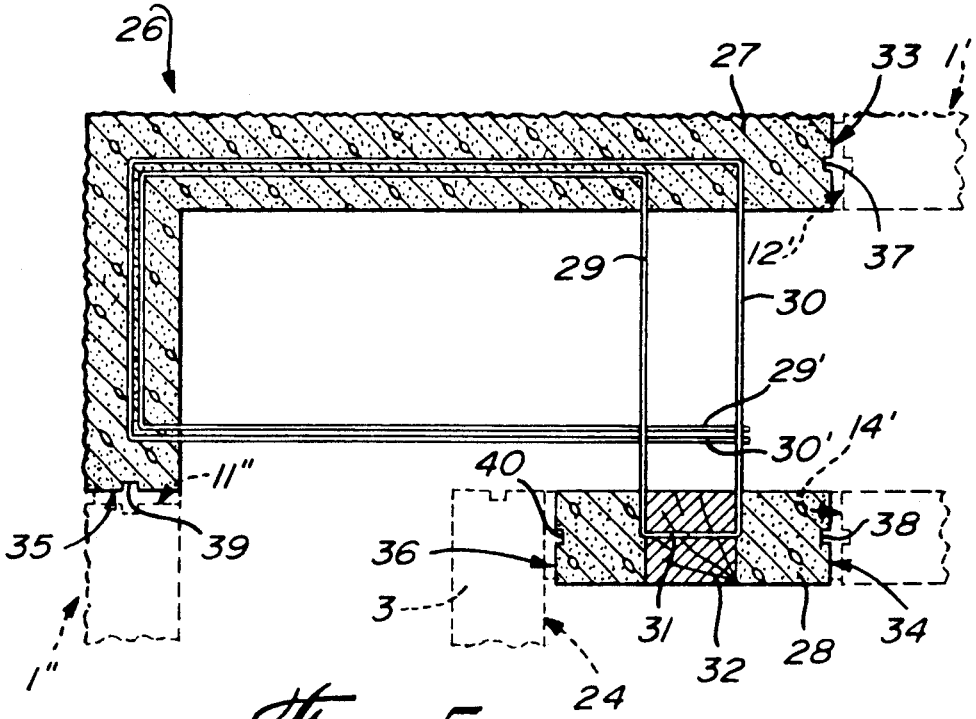
FIG. 5 is an horizontal cross sectional view of a corner block in accordance with the invention.
Figure 6:
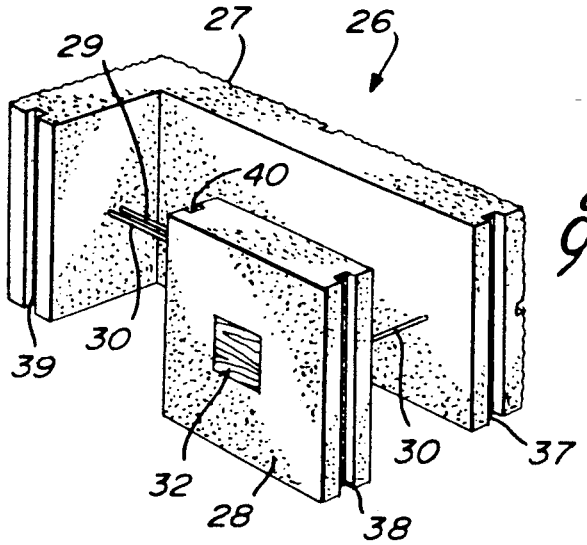
FIG. 6 is a perspective view of the corner block of FIG. 5.

The corner block 26 of FIGS. 5 and 6 is designed to ensure adequate strength of the corners of the constructed wall 6 (FIG. 7) and also to ensure imperviousness of this corner. It comprises an outer right angle wall 27 and an inner planar wall 28. The right angle wall 27 can be made of the same material(s) as the outer wall 2 while the inner wall 28 is made of concrete as the wall 3.

The walls 27 and 28 are secured to each other by means of a tie member including a pair of cylindrical steel rods 29 and 30 having a diameter of 3/16 inch. The rods 29 and 30 each comprise respective free ends bent for insertion into a hole 31 of a solid and cubic body 32 made of the same material as the bodies 18 and 19. The rods 29 and 30 are lying in a generally horizontal plane and they extend parallel between the walls 27 and 28 with a distance between them adequate to receive he cubic body 32 and ensure proper stiffness of he tie member. They are also bent to follow side by side the geometry, including the corner, of the right angle outer wall 27 and thereby reinforce this wall 27, and are bent again toward the sections thereof between the body 32 and the wall 27. The ends 29' and 30' of he rods are welded to the latter rod sections to prevent the inner wall 28 from moving with respect to outer wall 27 and thereby avoid opening out o the wall corner.

The concrete or other composition of the outer wall 27 is poured around the rods 29 and 30 while the concrete of the inner wall 28 is poured around these rods and the cubic body 32. The walls 27 and 28 of the corner book 26 are therefore fixedly secured to each other through the rods 29 and 3.

Again, an edge of h cubic body 32 has a length equal the thickness of the inner wall 28. This body therefore enables nailing and/or screwing from the inside of the wall 6 (FIG. 7) through the concrete wall 28 with the nails and or screws extending in the space between he walls 27 and 28. The body 32 is centered on the eh wall 28 to be firmly fixed into the concrete, and is positioned at a distance from the inner corner of the erected wall 6 to facilitate finishing of the inside of that wall 6.

As shown in FIG. 5, a building block 1' can be placed adjacent the corner bock 26 with the end surfaces 12' and 14' of the block 1' abutting against end surfaces 33 and 34 o the walls 27 and 28, respectively. Another building block 1" can be placed adjacent the corners block 26 with another end surface 35 of the wall 27 abutting against the end surface 11" of the block 1" and with another end surface 36 of the inner wall 28 abutting against the outer surface 24 of the wall 3" for block 1". Obviously, the blocks 1' and 1" are similar to the building block of FIGS. 1–4. As can be appreciated, the distance between the corner and the block 1' corresponds to the legit of a block 1 while the distance between the corner and the block 1" corresponds to half the length of a building block 1 whereby the corner block 26 can be easily used to form corners in the erected wall 6 (FIG. 7). Of course, the thickness of the walls 27 and 28, the distance between these walls, and the height thereof are the same as in the case of the walls 2 and 3 of the building block 1.

To improve the binding between the different blocks 26, 1' and 1" by means of mortar, the end surfaces 33, 34, 35 and 36 of the walls 27 and 28 are formed with vertical and centered grooves 37, 38, 39 and 40, respectively.

As shown in FIGS. 1, 2, 4, 6 and 7, the top and bottom surfaces of the blocks 1 and 26 are flat to facilitate withdrawal of the blocks from the mold.

After the wall 6 (FIG. 7) has been erected using blocks such as 1 and 26, the empty space 42 between the walls 2 and 3 and the walls 27 and 28 can be filled with loose fill insulation 41 such as for example injected loose glass wool. The distance between the inner and outer walls of the blocks can obviously be varied depending on the level of insulation required by the climate of the region of concern. However, the above mentioned distance of 6 inches gives a good stability to the building block 1.

The building blocks in accordance with the present invention present, amongst others, the following advantages:

the outside of the walls constructed with these blocks is finished and requires no additional covering;

they can be insulated by simply filling with loose fill insulation 41 their empty inner space 42;

the cubic bodies embedded into the concrete of the inner wall of the blocks provide for nailing and/or screwing of the inside finishing materials, which bodies are attached to and therefore also retained by the tie members;

the blocks of the invention can be used to produce a continuous wall from the footing to the roof of a building, including the foundations and the exterior wall; then, when the empty space in such a wall has been filled with insulation, any heat losses through that wall from the concrete footing to the roof is eliminated;

the bodies of wood embedded in the concrete of the inner walls of the blocks enable nailing and/or screwing the end and floor joists of for example a residential house; and the blocks of the invention can be produced at low cost using the equipment, slightly modified, already installed and used to manufacture conventional concrete blocks; the initial investment for producing blocks in accordance with the invention is also greatly reduced.

Although the present invention has been described hereinabove by way of a preferred embodiment thereof, such an embodiment can be modified at will, within the scope of the appended claims, without departing from the spirit and nature of this invention.

What is claimed is:

1. A building block comprising:

outer and inner walls of which at least said inner wall is made of hard moldable material such as concrete, said inner wall comprising an outside side and an inner side;

at least one elongated tie member for interconnecting said walls with a space separating the outer wall from the inner wall, said tie member having a first end fixedly secured to the outer wall and a second end fixedly secured to the inner wall; and a body made of material through which nails and/or screws can be driven, said body being fastened to said second end of the tie member and being embedded in the said material of the inner wall with a first surface thereof exposed on said outer side and with a second surface thereof exposed on said inner side whereby nails and/or screws can be driven through said body from the outer side of the inner wall with the nails and/or screws extending through said first surface, said body, said second surface and said space.

2. The building block of claim 1, in which the said body is a solid and cubic body comprising a plurality of edges each having a length equal to the thickness of the said inner wall.

3. The building block of claim 2, in which the said solid and cubic body is made of wood.

4. The building bock of claim 1, wherein the said body is made of wood.

5. A building block comprising:

outer and inner walls of which at least said inner wall is made of hard moldable material such as concrete, said inner wall comprising an outer side;

at least one elongated tie member for interconnecting said walls with a space separating the outer wall from the inner wall, said tie member having a first end fixedly secured to the outer wall and a second end fixedly secured to the inner wall; and a body made of material through which nails and/or screws can be driven, said body being fastened to said second end of the tie member and being embedded in the said material of the inner wall with a surface thereof exposed on said outer side to enable nailing and/or screwing though the said body;

wherein aid body comprises two opposite surfaces formed with first and second holes, respectively, and wherein the said second end of the elongated tie member is forked to define first and second branches embracing a portion of the body and having respective free ends bent to penetrate said first and second holes, respectively.

6. A building block comprising:

outer and inner walls of which at least said inner wall is made of hard foldable material such as concrete, said inner wall comprising an outer side;

at least one elongated tie member for interconnecting said walls with a space separating the outer wall from he inner wall, said tie member having a first end fixedly secured to the outer wall and a second end fixedly secured to the inner wall; and a body made of material through which nails and/or screws can be driven said body being fastened to said second end of the tie member and being embedded in the said material of he inner wall with s surface thereof exposed on said outer side to enable nailing and/or screwing through the said body;

wherein (a) said building block is a corner block (b) said outer wall is an angular wall defining first and second outer wall sections angularly disposed with respect to each other, (c) said tie member interconnects the first outer wall section with the said inner wall, (d) said corner block further comprises an elongated reinforcing member interconnecting he second outer wall section and said tie member, (e) said outer angular wall comprises a hard moldable material such as concrete, (f) said first end of the tie member is embedded in the material of the first outer wall section while the reinforcing member comprises an end embedded in the material of said second outer wall section, and (g) said first end of the tie member and said embedded end of the reinforcing member being interconnected through an elongated and angular member embedded in the said material of the outer angular wall for reinforcing said outer wall.

7. A building block comprising:

outer and inner wall of which at least said inner wall is made of hard moldable material such as concrete, said inner wall comprising an outer side;

at least one elongated tie member or interconnecting said wall with a space separating the outer wall from the inner wall, said tie member having a first end fixedly secured to the outer wall and a seconds end fixedly secured to the inner wall; and a body made of material through which nails and/or screws can be driven, said body being fastened to said second end of the tie member and being embedded in the said material of the inner wall with a surface thereof exposed on said outer side to enable nailing and/or screwing through the said body;

wherein said body comprises two opposite surfaces formed with first and second holes, respectively, and wherein said tie member comprises a pair of tie rods having respective ends bent to penetrate said first and second holes, respectively.

* * * * *